United States Patent [19]

Pepper, Sr. et al.

[11] Patent Number: 4,542,840

[45] Date of Patent: Sep. 24, 1985

[54] SLING HOOK

[76] Inventors: John T. Pepper, Sr., 5208 Varnum St., Bladensburg, Md. 20710; Brian A. Felter, 1818 Taylor Ave., Ft. Washington, Md. 20744

[21] Appl. No.: 583,202

[22] Filed: Feb. 24, 1984

[51] Int. Cl.[4] ..... F41D 11/00

[52] U.S. Cl. ..... 224/150; 224/913

[58] Field of Search ..... 224/150, 913; 2/321; 24/2.5, 265 H, 230.5 R, 318, 369, 374

[56] References Cited

U.S. PATENT DOCUMENTS

| | | | |
|---|---|---|---|
| 1,446,781 | 2/1923 | Benson | 24/230.5 R X |
| 1,453,706 | 5/1923 | Crosby | 24/369 |
| 2,481,884 | 9/1949 | Short | 224/913 X |
| 2,608,733 | 9/1952 | Wilber . | |
| 2,867,026 | 1/1959 | Gale | 24/369 X |
| 3,319,852 | 5/1967 | Perkins | 224/150 |
| 3,885,250 | 5/1975 | Schiller | 2/321 |
| 3,927,808 | 12/1975 | Steen | 224/267 |
| 4,182,469 | 1/1980 | Bennett | 224/913 X |
| 4,299,343 | 11/1981 | Atchisson | 224/913 X |

*Primary Examiner*—Stephen Marcus
*Assistant Examiner*—Robert Petrik

[57] ABSTRACT

A sling hook adapted for attachment to a long gun, such as a rifle, having a forend and a sling attached to the forend. The sling hook is adapted for attachment of the sling hook to the sling, such as a buckle and a hook portion connected to the buckle and adapted for formation of a sling loop around a forend arm of a shooter. The loop is formed by capture of the sling with the hook between the forend arm and the attachment position of the sling to the forend.

14 Claims, 9 Drawing Figures

19
18
12
16
14
15
16
10
26

22
24
22
24

SLING HOOK

BACKGROUND OF THE INVENTION

The invention relates to slings for long guns and attachments therefor.

It has been well-known to use slings attached to long guns, such as rifles, by means of forend and buttstock swivels for purposes of carrying the weapon while not in use, and for supporting the forend arm of a shooter, i.e., the arm that grasps the forend of the weapon while a shooter is in a firing position. Support of the forend arm is accomplished by positioning the upper portion thereof relative to the rifle stock with as little relative movement therebetween as feasibly possible, by connecting the sling under tension between the upper portion of the forend arm and the forend sling swivel. In this manner, bones of the forend arm are rigidly supported relative to the rifle, which reduces relative movement between the forend arm and rifle, that might be caused by muscle tremors. Reduction in the aforementioned relative movement increases marksmanship abilities, because the rifle is held steady; thus the bullet will travel along the sighted course desired by the shooter.

In the past, slings have been used to support the forend arm relative to the rifle stock. One known means of positioning the forend arm is a military loop sling, shown in U.S. Pat. No. 1,396,270. In a military loop sling, the forend arm is passed through a loop formed in the sling. The loop is tensioned relative to the upper position of the forend arm by means of a keeper, which takes excess play out of the loop and thereby rigidly locks the loop relative to the arm. On the average, it takes an experienced rifleman over 20 seconds to "sling up" and attain a firing position with a military loop sling. In a military or hunting situation, a shooter may not have 20 seconds available to commence firing. Also, long training sessions are required in order to learn proper slinging-up techniques. The military loop sling also has many moving parts requiring fitting and experimentation by a shooter, in order to obtain the optimal adjustments for his body configuration.

A military loop sling is also cumbersome and it is difficult to sling-up while in a prone position. As a consequence, many military shooters and hunters do not bother using a military-type loop sling except in very specialized applications such as competitive target shooting, sniping, or very long distance shooting. Shooters who do not use forend arm-supporting sling,s whether due to a lack of time or trailing experience, do not acquire the marksmanship benefits available therefrom.

Another type of supporting sling is a combination arm band and rifle sling, such as shown in U.S. Pat. No. 2,481,884, which has a rifle sling attached to the rifle and a separate arm band that is worn around the shooter's upper portion of his forend arm. The arm band must always be worn around the shooter's forend upper arm in order to use the sling assembly very quickly. In use, a metal projecting tab attached to the sling is engaged in a ring attached to the arm band, thereby effectuating rigid connection between the rifle sling and the forend upper arm. The combination arm band and rifle sling is not complete as a supporting unit unless both the band and sling are used simultaneously. Under battlefield or hunting conditions, the addition of the extra arm band component decreases reliability because it may be lost or broken. It is therefore desirable to have the minimum number of components having the simplest construction so as to increase reliability.

SUMMARY OF THE INVENTION

It is an object of the present invention to design and construct a sling system and method for use that allows rapid engagement of sling and attainment of a sling-supported firing position within a mere few seconds. A second object of the present invention is to create a sling that can be engaged from any shooting position while in any body position that allows easy disengagement of the sling. A third object of the present invention is to design a sling having ease of use that requires little training time. A fourth object of the present invention is to create a sling having a very simple mechanical design that is adaptable to existing long gun swivel arrangements and sling configurations at minimum expense.

These objects have been attained by a sling hook constructed in accordance with the features of the present invention which has means for attachment of the sling hook to a sling of any known configuration. When a sling is attached both to the sling hook and a long gun, the sling hook has means for formation of a sling loop around a forend arm of a shooter by capture of the sling between the shooter's forend arm and the attachment of the sling to the long gun forend. The loop formation means is connected to the means for attachment and it includes a hook portion.

The present invention features means for attachment of the sling hook to a rifle sling mounted thereon for threading a sling through the buckle in a belt-like fashion, the means for attachment can also be a keeper for slidable captured passage of a sling therethrough and at least one frog hook attached to the keeper portion engagable in holes defined by a sling. Alternatively, the means for attachment can be a rigid keeper portion for slidable captured passage of a sling therethrough and means for biasing the sling passing through the keeper into contact with the keeper. This last-mentioned biased engagement mechanism can be a freelander-type attachment mechanism, or a military-style camming action sling adjuster. The means for formation of a loop can be a hook of any configuration that allows the capture of a sling therein.

The features of the present invention attain the stated objects and overcome the shortcomings of the other sling designs noted above. The sling hook, when used in conjunction with any known sling design allows a shooter to create a self-tensioning loop on his forend upper arm in only a few seconds from any shooting position or body position and to remove the same within a similarly short time perid. The training time necessary to perfect use of the sling hook is, on average, only a few hours. The sling hook can be manufactured in a unitary, one-piece construction and adapted to fit any known sling design.

A more complete understanding of the present invention can be realized by reference to the following drawings and detailed description.

DESCRIPTION OF THE PREFERRED EMBODIMENTS

Figures 1, 2, 3:
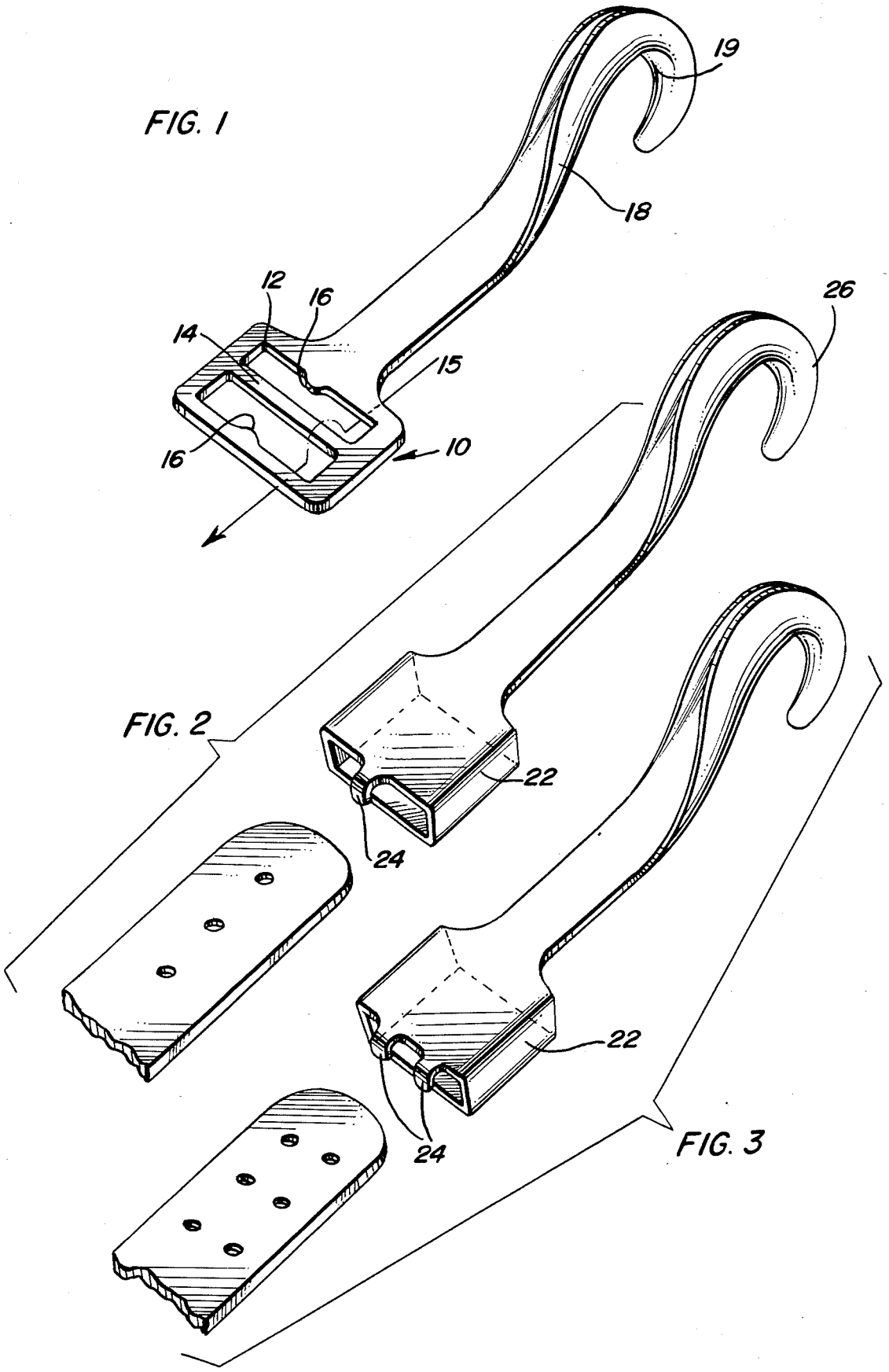
FIG. 1 is a perspective view of a sling hook constructed in accordance with the teachings of the present invention.
FIG. 2 is a perspective view of an alternative embodiment of a sling hook.
FIG. 3 is a perspective view of another alternative embodiment of a sling hook.

FIG. 1 shows a sling hook 10 having means for attachment of the sling hook to a rifle sling, such as the generally rectangular buckle 12, including a staff 14 mounted transverse the buckle. A sling can be threaded through the buckle 12 in the manner shown by the arrow 15. It is highly desirable that the means for attachment prevent relative movement therebetween. As shown in FIG. 1, the staff 14 can be offset to a height differing from that of the rest of buckle 12, so as to insure strong frictional engagement between the means for attachment and a sling threaded therethrough. In order to aid in frictional engagement, the buckle 12 may also have optional projections 16 that cause additional engagement with the sling. However, it is desirable that the projections 16 have dull edges in order to prevent cutting into the sling material. While the buckle is shown as generally rectangular, it should be understood that any shape of buckle structure can be utilized so long as it is possible to thread a sling therethrough in relatively strong frictional engagement with the buckle so as to prevent undesirable relative movement therebetween. The means for attachment can even provide for permanent fixed attachment to a sling, but at the cost of preventing adjustment in sling hook position on the sling.

Sling hook 10 also has means for formation of a sling loop around the forend arm of a shooter when a sling it attached to the rifle swivels. As shown in FIG. 1, the means for formation of a self-tensioning loop is a hook 18 that is connected to buckle 12. As can be seen by the general construction of the hook 18, it can capture any long linear object that enters the opening 19 defined by the hook, such as a rifle sling. It is preferred that hook 18 define generally rounded and smooth edges to prevent snagging on objects, including a shooter, and to allow easy slip-free relatively frictionless movement between the hook and a portion of a sling that may be passing through the opening defined by the hook to insure formation of a self-tensioning loop. It is contemplated that any configuration of hook be used as long as it is capable of capturing a sling therein. Other contemplated means for loop formation include spring-loaded carabiners or hasps.

The hook may be positioned relative to the means for attachment as desired. However, it is generally desired that the hook 18 be positioned parallel to the orientation of the sling as it passes through the buckle 12, i.e., parallel to the arrow 15. It is also desirable that the hook 18 be oriented so that the end distal the attachment means faces the forend sling swivel.

FIGS. 2 and 3 show alternate means for attachment of the sling hook to a sling including a keeper portion 22 for slidable captured passage of a sling therethrough and one or more frog hooks 24 that engage in holes already cut in a sling. The embodiment shown in FIG. 3 having two frog hooks 24, is readily adaptable to existing military-type loop slings. Thus, a shooter who already owns a military loop sling can utilize it with a sling hook of the present invention. The embodiment shown in FIGS. 2 and 3 also have hooks 26 for formation of a self-tensioning loop and is constructed in accordance with the hook structure 18 shown in FIG. 1.

Figure 4:
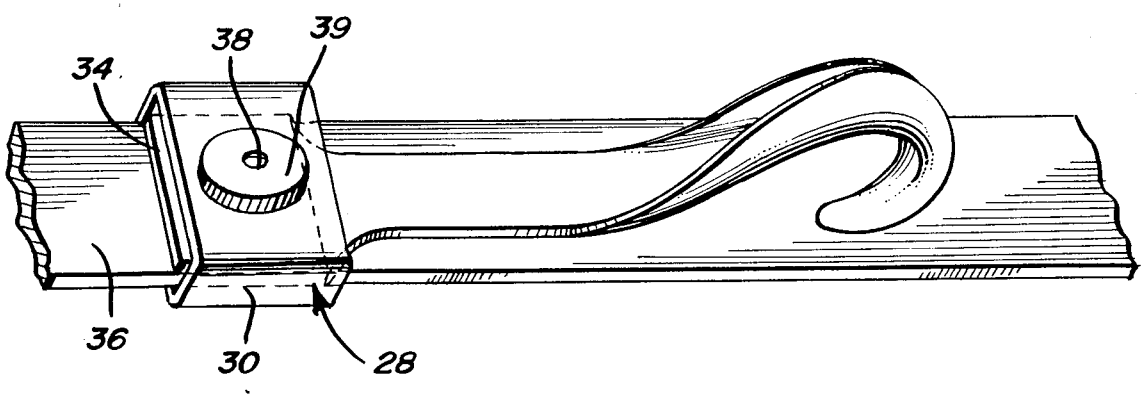
FIG. 4 is a perspective view of another embodiment of a sling hook.

FIG. 4 shows a freelander-type sling slide 28 that may be used for attachment of the sling hook to a sling. The freelander-type attachment means has a generally rigid keeper portion 30 for slidable captured passages of a sling therethrough and means for biasing the sling passing through said keeper into contact with the keeper to prevent relative movement therebetween. As shown in FIG. 4, this biasing means can be a plate 34 that is biased against a sling 36, by means of a threaded member 38 and a threaded knob 39. Rotation of the knob in one direction biases the plate 34 toward sling 36 thereby capturing the sling between the plate and keeper 30. It is contemplated that other biasing means may be used, such as a cam-locking, well-known U.S. military sling slide, that is not shown.

Figure 5:
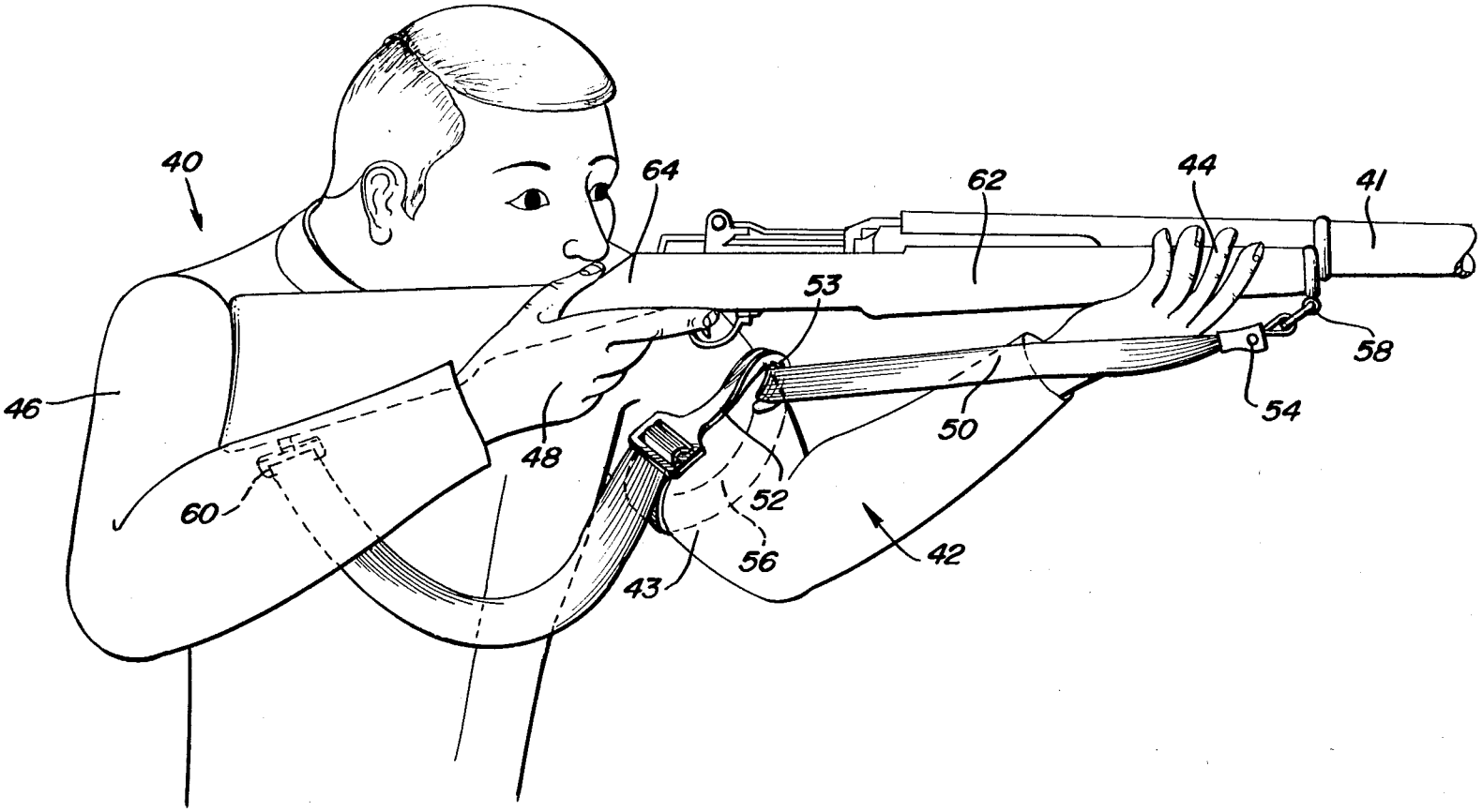
FIG. 5 shows a sling hook being used to form a loop on the upper forend arm of a shooter.

FIG. 5 shows a sling hook in use while forming a self-tensioning loop on the upper forend arm of a shooter 40. The shooter is shown in a prone position, but any practical or desired field position may be used, such as sitting, standing, kneeling, squatting, or any combination thereof that allows a shooter to adapt to the shooting terrain.

As shown in FIG. 5, the shooter 40 is supporting the forend of the rifle 41 with the forend arm 42, including upper forend arm 43 and forend hand 44. The grip area of the rifle is held and supported with the grip arm 46 and grip hand 48. Attached to the rifle is a rifle sling 50 of a known design, and attached to the sling is a sling hook 52 with hook portion 53 such as that shown in FIG. 1. If desired, the sling 50 may also incorporate a sling slide 54 for adjusting the length of the sling. As is shown, the sling 50 passes between the upper forend arm 43 and the shooter's torso and a loop 56 is formed thereabout by capturing the sling within the hook portion 53 between the upper arm and the forend swivel 58 of the rifle. The loop 56 formed by the sling hook 52 is selt-tightening, due to the slidable relationship between the hook 53 and the encaptured sling. Any rearward movement of forend arm 42 creates tension on the sling, which in turn tightens the loop. The rear portion of the sling, between the sling hook 52 and the butt (rear) rifle swivel 60, is allowed to remain flacid.

Figure 6:
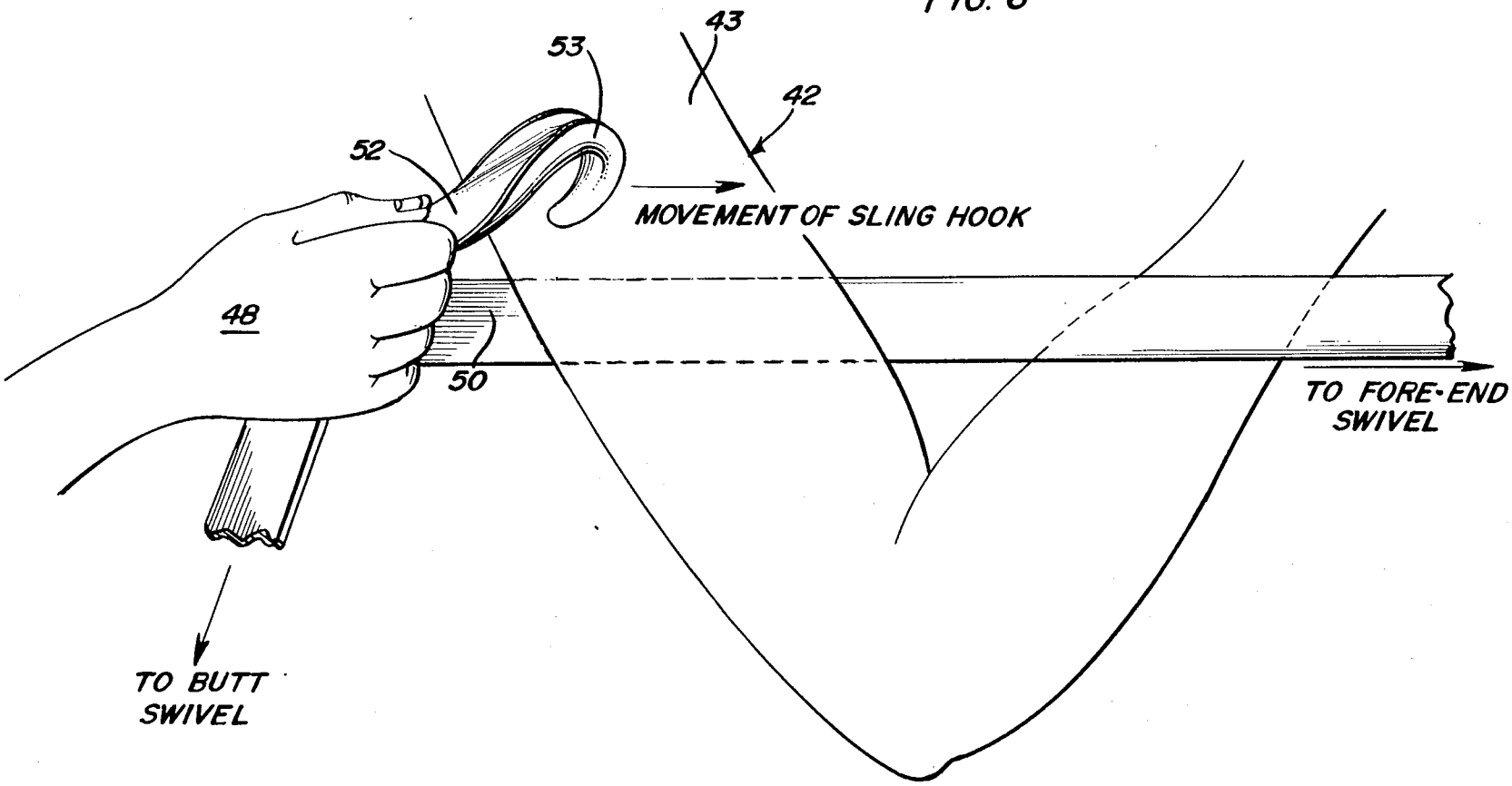
FIG. 6 shows a shooter positioning a sling hook around his forend arm.
Figure 7:
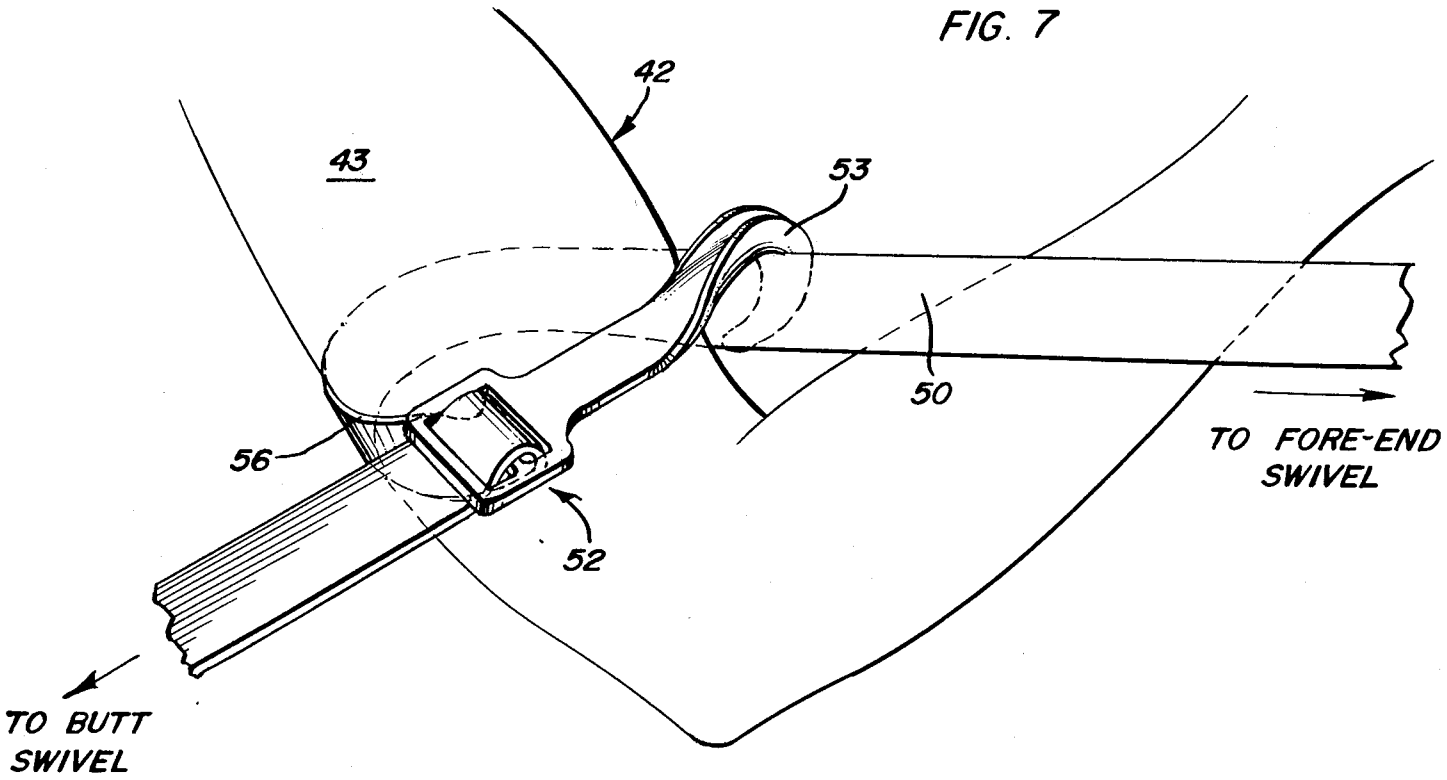
FIG. 7 shows a self-tensioning loop formed around the upper forend arm of a shooter.

Referring to FIGS. 5–7, the sling hook 52 is used along with a sling 50 as follows. The sling 50 and sling hook 52 may be used with the rifle in any position. The forend of the rifle is held with the forend hand 44 on the forend 62. The sling 50 is free and hanging with the hook 53 of the sling hook 52 generally facing towards the forend swivel 58. The grip hand 48 simultaneously holds the rifle near the receiver at the grip 64.

When the shooter desires to loop-up, the grip hand 48 leaves the rifle grip 64 and is placed between the rifle stock and the body. In this position, the grip hand 48 is used to grab the sling hook 52. At this point in time, if necessary, any restraining means that may be holding the sling hook 52 stationary relative to the sling 50 should be disengaged. The grip hand 48 now grasps the sling hook 52 preferably between the thumb and index finger. Next, the forend arm 42 elbow is thrust between the rifle stock and the sling 50. The sling hook 52 is drawn between the torso and the forend arm 43 and thereafter around the upper forend arm 43. As with military slings, it is desirable to form the sling loop as close to the armpit of the forend arm as is feasibly possible, to ensure maximum support of the arm. The hook 53 then engages and captures the sling material somewhere between the upper forend arm 43 and the forend swivel 58. The shooter may want to chinch up the hook closer to the bicep of the forend upper arm 43 so as to decrease the size of the loop 56. However, it is not necessary to do this and the loop 56 can be entirely self-tensioning.

The grip hand 48 now assumes its position on the rifle grip 64. At this point, the forend hand 44 releases the forend 62; it is translated under the rifle toward the muzzle, whereupon the forend hand 44 is drawn between the shoulder of the upper forend arm 43 and the sling 50. The forend hand 44 then is inserted between the sling 50 and the forend 62 of the rifle and assumes a normal forend grasp. Forend hand 44 grasps the rifle and the outside wrist portion opposite the thumb is in contact with the sling as it is with military loop slings. Once contact is reestablished between the forend 62 and the forend hand 44, the rifle is shouldered.

If the above steps have been followed, the shooter will now have the sling between the sling hook 52 and the forend swivel 58 in a completely taunt configuration that is exerting pressure on the outside portion of the forend wrist of the arm 42. Thus, the sling, when used with the sling hook of the present invention, provides stable support for the forend arm. The portion of the sling between the sling hook 52 and the rear sling swivel 60 is of no consequence and may be flacid.

With a little practice, a shooter can perfect the above-noted looping-up technique within two seconds or less. In order to disengage the sling and sling hook from the shooter's forend arm, the shooter only need release the hook with a short tug between the hook 53 of the sling hook 52 and sling material encaptured therein.

When the sling hook is not being used to form a loop, the hook portion is free to move relative to the sling. Under field conditions the hook position might become entangled in the shooter's clothing or on other objects. It is desirable to avoid potential entanglement and means have been devised for restraining the hook portion of the sling hook relative to a sling attached thereto, as is shown in FIGS. 8 and 9.

Figure 8:
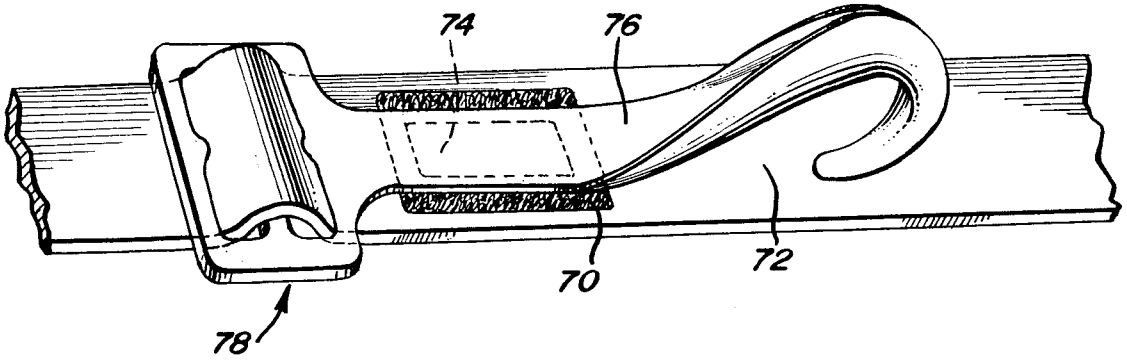
FIG. 8 is a view of a sling hook and restraining means.

In FIG. 8, the restraining means is a pile-and-loop fastener wherein one portion 70, (e.g. the pile) is affixed to the sling 72 and the other portion (e.g. the loops) is affixed to the hook portion 76 of the sling hook 78. Pile-and-loop fasteners are sold by Velcro Corporation under the VELCRO trademark. The fastener is disengaged in order to utilize the sling hook merely by tugging on the hook portion 76.

Figure 9:
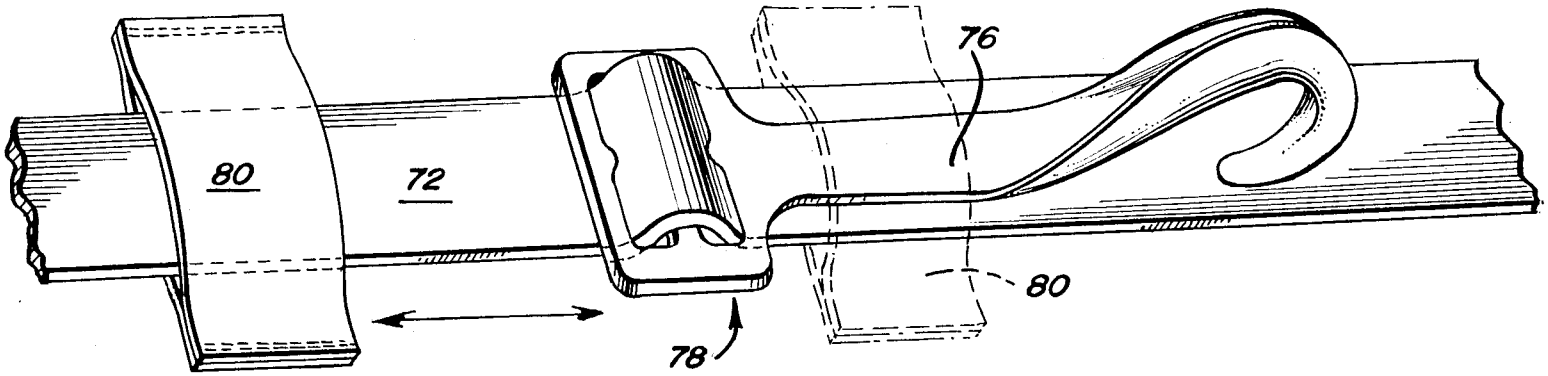
FIG. 9 is a view of an alternative embodiment of a restraining means.

In FIG. 9, the restraining means is a sliding sleeve 80 that surrounds the sling 72 and hook portion 76. When sleeve 80 covers the hook portion 76, relative movement between the sling and hook is thereby prevented. Slidably reciprocating the sleeve 80 off the hook portion 76 disengages the restraining means and allows use of the sling hook for loop formation.

The aforementioned construction of the sling hook and method for utilization with a sling have been described by means of an examples. Those skilled in the art will appreciate that variations of the looping-up technique and construction of the sling hook can be performed without departing from the scope or spirit of the present invention.

We claim:

1. A sling hook adapted for attachment to a long gun having a forend and a sling attached to the forend comprising:

means adapted for attachment of said sling hook to the sling; and means for formation of a sling loop by sling passage around a forend arm of a shooter and capture of the sling between the forend arm and the attachment of the sling to the forend, said loop formation means being connected to said means for attachment and including a hook portion for the capture of the sling.

2. The sling hook as recited in claim 1 wherein said means for attachment comprises a buckle including a staff mounted on said buckle for threading a sling through said buckle and staff in a belt-like fashion.

3. The sling hook as recited in claim 2 wherein said buckle has protuberances projecting therefrom for engagement with a sling.

4. The sling hook as recited in claim 1 wherein said means for attachment comprises a keeper portion for slidable captured passage of a sling therethrough and at least one frog hook attached to said keeper portion adapted for engagement in holes defined by a sling.

5. The sling hook as recited in claim 1 wherein said means for attachment comprises a rigid keeper portion for slidable captured passage of a sling therethrough and means for biasing a sling passing through said keeper into contact with said keeper.

6. The sling hook as recited in claim 1 wherein said hook portion of said means for loop formation defines rounded edges.

7. The sling hook as recited in claim 1 comprising means for selectively restraining said hook portion relative to the sling when said sling hook is attached thereto, said hook portion remaining in a fixed position relative to the sling.

8. The sling hook as recited in claim 7 wherein said restraining means is a pile-and-loop fastener, one portion of said fastener being attached to said hook portion and the other portion of said fastener being attached to the sling.

9. The sling hook recited in claim 7 wherein said restraining means is a sleeve adapted for slidable reciprocation over said hook portion and the sling.

10. A sling hook adapted for attachment to a long gun having a forend and a sling attached to the forend comprising:

a buckle portion adapted for captured passage of a sling therethrough; and means for formation of a sling loop by sling passage around a forend arm of a shooter and capture of the sling between the forend arm and the attachment of the sling to the forend, including a hook portion for the capture of the sling in an opening defined by said hook portion, said means for loop formation being connected to said buckle portion.

11. The sling hook as recited in claim 10 comprising means for selectively restraining said hook portion relative to the sling when said sling hook is attached thereto, said hook portion remaining in a fixed position relative to the sling.

12. The sling hook as recited in claim 11 wherein said restraining means is a pile-and-loop fastener, one portion of said fastener being attached to said hook portion and the other portion of said fastener being attached to the sling.

13. The sling hook as recited in claim 11 wherein said restraining means in a sleeve adapted to slidable reciprocation over said hook portion and the sling.

14. A rifle support strap comprising:

a sling for attachment to a long gun forend swivel; and a sling hook having means adapted for attachement of said sling hook to said sling, and means for formation of a sling loop by passage of said sling around a forend arm of a shooter and capture of said sling between the forend arm and the swivel, said loop formation means being connected to said means for attachment and including a hook portion for the capture of said sling.

* * * * *